United States Patent [19]

Morishita et al.

[11] Patent Number: 4,847,580

[45] Date of Patent: Jul. 11, 1989

[54] SOLENOID-OPERATED SWITCH FOR A STARTER

[75] Inventors: Akira Morishita; Akio Seta, both of Himeji, Japan

[73] Assignee: Mitsubishi Denki Kabushiki Kaisha, Tokyo, Japan

[21] Appl. No.: 116,684

[22] Filed: Nov. 4, 1987

[30] Foreign Application Priority Data

Nov. 5, 1986 [JP] Japan ..... 61-169742[U]

[51] Int. Cl.[4] ..... H01H 67/02

[52] U.S. Cl. ..... 335/126; 335/131; 335/278

[58] Field of Search ..... 335/278, 131, 133, 214, 335/129, 130, 126, 104, 193, 90

[56] References Cited

U.S. PATENT DOCUMENTS

| | | | |
|---|---|---|---|
| 4,149,131 | 4/1979 | Kawamura et al. | 335/278 |
| 4,327,300 | 4/1982 | Hoven . | |
| 4,450,423 | 5/1984 | Morishita | 335/133 |

*Primary Examiner*—E. A. Goldberg
*Assistant Examiner*—Lincoln Donovan
*Attorney, Agent, or Firm*—Oblon, Spivak, McClelland, Maier Neustadt

[57] ABSTRACT

A solenoid-operated switch for a starter comprises a movable contact driven by the action of a solenoid and a stationary contact facing the movable contact. An iron plate covers an area where the movable and stationary contacts are mutually brought to contact.

1 Claim, 1 Drawing Sheet

SOLENOID-OPERATED SWITCH FOR A STARTER

BACKGROUND OF THE INVENTION

1. Field of the Invention

The present invention relates to a solenoid-operated switch for a starter for an automobile to control a current to be fed to the starter.

2. Discussion of Background

FIG. 2 shows a conventional solenoid-operated switch for a starter of this kind. In FIG. 2, a movable contact 1 is attached to a rod 3 through an insulator 2. The rod 3 is inserted in a core 4 so as to be slidable in its axial direction. A stationary contact 5 is fixed to a cap 6 of an insulating material, which is a rear part of the solenoid-operated switch, by means of a nut so as to face the movable contact 1. An annular exciting coil 8, which is wound on a bobbin made of a resinous material, is attached to the inner wall of an iron housing 11. A plunger 9 is inserted in the exciting coil 8 to be movable in its axial direction upon exciting the coil 8. A socket portion 11a is formed at the rear part of the housing 11. The outer periphery of the core 4 and the front end part of the cap 6 are fixed to the socket portion 11a by a caulking operation. A reference numeral 12 designates a lead wire for connecting the stationary contact 5 to brushes (not shown) in the starter.

The conventional solenoid-operated switch operates as follows.

On turning a key switch (not shown), the exciting coil 8 is actuated to move the plunger 9 backwardly (on the lefthand in FIG. 2). Then, the rod 3 is pushed backwardly to bring the movable contact 1 in contact with the stationary contact 5, whereby an electric current is fed to the brushes of the starter through the lead wire 12 via the stationary contact so that an armature produces a torque.

In the conventional solenoid-operated switch having the stationary and movable contacts which are mutually brought to contact in the cap 6, when they come to contact with each other, there takes place sparks which cause noises or electromagnetic induction. The noises easily leak outside and may result in erroneous ignition to the engine through a cord of the distributor, for instance.

SUMMARY OF THE INVENTION

It is an object of the present invention to provide a solenoid-operated switch for a starter which eliminates leakage of noises which are caused by the mutual contact of the stationary and movable contacts.

The foregoing and the other objects of the present invention have been attained by providing a solenoid-operating switch for a starter which comprises a housing; an annular exciting coil attached to the inner wall of the housing; a plunger held at one side of the housing in the inner bore of the annular exciting coil so as to be slidable in its axial direction; a movable rod slidably supported by a core which is attached to the housing at the other side of the same; a cap fixed to the core; a stationary contact fixed to the cap in a cavity formed by the core and the cap; a movable contact attached to the movable rod to face the stationary contact; and a plate of magnetic substance covering around an area where the movable contact comes to contact with the stationary contact.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
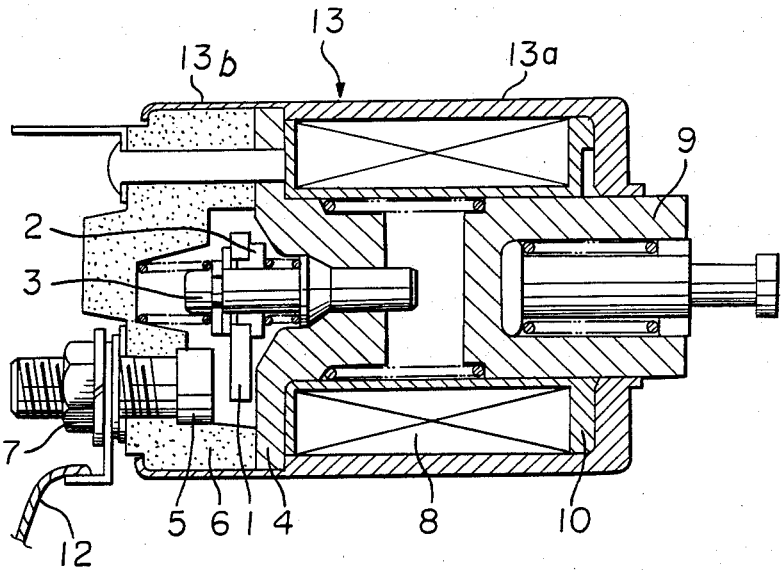
FIG. 1 is a longitudinal cross-sectional view of an embodiment of the solenoid-operated switch for a starter according to the present invention.
Figure 2:
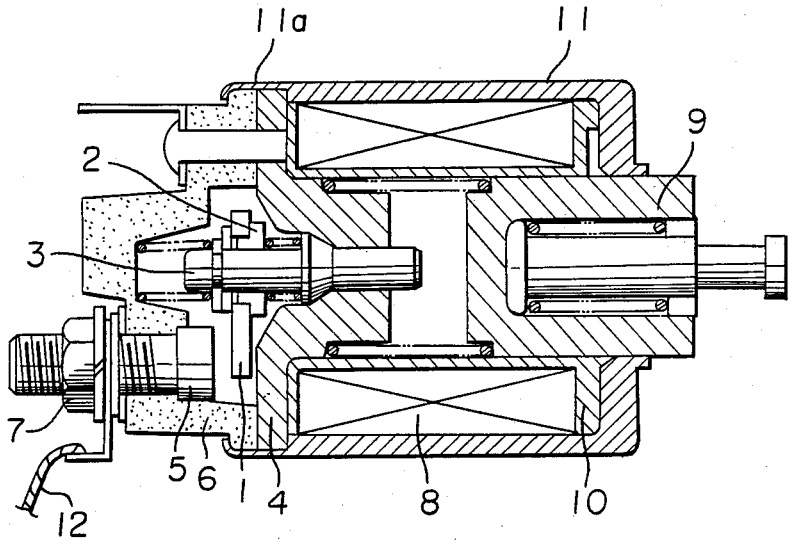
FIG. 2 is a longitudinal cross-sectional view of a conventional solenoid-operated switch for a starter.

Referring now to the drawings, wherein the same reference numerals designate the same or corresponding parts, and more particularly to FIG. 1 thereof, there is shown a longitudinal cross-sectional view of an embodiment of the solenoid-operated switch for a starter according to the present invention.

In FIG. 1, a reference numeral 13 designates a housing made of iron which comprises a main housing part 13*a* in which the exciting coil 8, the plunger 9 and so on are housed, and a rear housing part 13*b* which extends on and along the outer circumferential surfaces of the cap 6 and the core 4 to cover the entire region of that areas. The rear housing part 13*b* secures the core 4 and the cap 6 by a caulking operation.

In the solenoid-operated switch of the present invention, since the cap 6 is covered by the rear housing part 13*b* made of iron which is a magnetic substance, electromagnetic induction caused by sparks which are resulted by the mutual contact of the stationary and movable contact 5, 1 is absorbed by the rear housing part 13*b* which functions as a shield. Accordingly, there takes place no noises from the solenoid-operated switch at the time of contacting, and there is no possibility of erroneous ignition of the engine.

In the embodiment shown in FIG. 1, the rear housing part 13*b* is formed integrally with the main casing part 13*a*. This provides such an advantage that there is no increase in the number of the structural elements and it only requires a slight increase in a material to be used.

Instead of the embodiment shown in FIG. 1, it is feasible that the rear housing part 13*b* may be a body separate from the main housing part 13*a*. However, the rear housing part 13*b* preferably covers the substantially entire region where the movable and stationary contacts are mutually contacted; more specifically, it covers the substantially entire region of the outer circumferential surface of the cap 6.

Thus, in the solenoid-operated switch of the present invention, a plate made of a magnetic material covers around an area where the movable contact comes to contact with the stationary contact. Accordingly, there is no leakage of noises due to the mutual contact of the stationary and movable contacts and erroneous operations in the external devices can be prevented.

Obviously, numerous modifications and variations of the present invention are possible in light of the above teachings. It is therefore to be understood that within the scope of the appended claims, the invention may be practiced otherwise than as specifically described herein.

What is claimed is:

1. A solenoid-operated switch for a starter which comprises:

a housing;

an annular exciting coil attached to the inner wall of said housing;

a plunger held at one side of said housing in the inner bore of said annular exciting coil so as to be slidable in its axial direction;

a core forming an end of said housing at another side thereof;

a movable rod slidably supported by said core;

a cap fixed to said core on a side thereof opposite said annular exciting coil;

a stationary contact fixed to said cap in a cavity formed by said core and said cap;

a movable contact attached to said movable rod to face said stationary contact; and means for containing electromagnetic inductive noise generated upon said movable contact engaging said fixed contact, comprising a plate of magnetic substance which is integral with said housing, said plate extending past said core and covering substantially the entire outer circumferential surface of said cap, including an area where said movable contact comes to contact with said stationary contact, while conforming to the configuration of said outer circumferential surface, whereby electromagnetic noise arising due to sparks between said movable and stationary contacts is isolated.

* * * * *